US005402860A

United States Patent [19]

Fry

[11] Patent Number: 5,402,860

[45] Date of Patent: Apr. 4, 1995

[54] EXPANDABLE WORKHORSE

[76] Inventor: Daniel L. Fry, 1 Locust, Fulton, Mo. 65251

[21] Appl. No.: 251,243

[22] Filed: May 31, 1994

[51] Int. Cl.[6] ..... B27B 21/06

[52] U.S. Cl. ..... 182/225; 182/153

[58] Field of Search ..... 182/153, 181, 224–226, 182/227

[56] References Cited

U.S. PATENT DOCUMENTS

| | | | |
|---|---|---|---|
| D. 245,105 | 7/1977 | Rader | D25/67 |
| 2,825,606 | 3/1958 | Rebensdorf | 182/153 |
| 3,734,235 | 5/1973 | Lanier | 182/153 |
| 3,741,339 | 6/1973 | Eubank | 182/186 |
| 3,934,676 | 1/1976 | Rice | 182/227 X |
| 4,711,319 | 12/1987 | Sansotta et al. | 182/155 |
| 4,763,757 | 8/1988 | Cheney | 182/21 |
| 4,819,762 | 4/1989 | Osborne | 182/225 |
| 4,926,966 | 5/1990 | Boudreau | 182/155 |

*Primary Examiner*—Alvin C. Chin-Shue

*Attorney, Agent, or Firm*—Henry S. Miller; David L. Baker

[57] ABSTRACT

Configured to resemble a classic sawhorse the invention is formed of rectangular metal tubes and "I" beams that are attached to and contained within a main beam. Side mounted tubes swing out and extend tubular members contained within them. "I" beams extend from the main beam and extend channel beams transverse to the longitudinal axis. Through a series of holes and pins the beam extensions and the supporting legs are adjustable over a wide range.

13 Claims, 4 Drawing Sheets

EXPANDABLE WORKHORSE

BACKGROUND OF THE INVENTION

1. Field of the Invention

This invention relates generally to shop tools and equipment and more particularly to an expandable sawhorse generally used in a carpentry workshop environment.

2. Description of the Prior Art

The sawhorse is one of the fundamental tools that has been used by carpenters and craftsmen world wide for centuries. The fundamental structure has not changed, only the uses of this light weight portable device seem to have increased. Representative examples of prior art similar devices are seen in the following U.S. Patents: U.S. Pat. No. 3,741,339 issued Jun. 26, 1973 to Eubank shows the classic structure, with a main beam supported by a pair of collapsible legs. Design patent, number Des. 245,105 issued Jul. 19, 1977 to Rader shows the classic design with a pair of parallel main beams and a pair of removable legs. Sansotta et al. show, in U.S. Pat. No. 4,711,319, issued Dec. 8, 1987 another sawhorse including a main beam formed from a metal channel(13) with a wooden face (18) and a pair of legs (12) that pivot and fold into the gap (27) between the flanges of the channel. U.S. Pat. No. 4,763,757 issued Aug. 16, 1988 to Cheney discloses a sawhorse including innovative intermediate plates below the main beam and between the support legs. The U.S. Pat. No. 4,926,966 issued to Boudreau on May 22, 1990 again shows the classic sawhorse with a main beam and a pair of legs that, in this case, pivot inwardly.

While the main function of the sawhorse is to support objects and things, none of the prior art devices provide the benefits that the present invention provides in the form of an ability to provide support over a wider surface area without materially increasing the size of the sawhorse itself.

SUMMARY OF THE INVENTION

The invention is an expandable sawhorse and because of the degree and extent of its expansion capability it is to be known as a workhorse. A single trestle main beam with two pair of adjustable legs is capable of supporting at least a single sheet of material such as plywood that is 7 feet long and 5 feet wide, 4 feet above the base surface of floor or ground. The invention takes up no more space in its unexpanded form then a single classic sawhorse.

The main beam of the workhorse is formed of a rectangularly shaped metal tube which contains two appropriately sized "I" beams. Each "I" beam is half the length of the main beam and moves in sliding engagement in and out of opposite ends of the metal tube. Each "I" beam has mounted within its channel, proximate the distal end, a hinged wing support member in the form of a metal channel. The wings on each end of the expanded structure extend to 90 degrees from the longitudinal axis of the main beam.

A pair of extensible wing members are mounted on each side of the main beam, proximate the connection of each of the pair of legs to the main beam. The wing members are formed of rectangular tubular metal, hinged to the main beam, and expand out to 90 degrees from the longitudinal axis. Within each wing is a wing extender formed of rectangular metal tubing of a smaller dimension then the wing itself and in sliding engagement with the wing.

Each pair of legs consists of two struts that are in a hinged connection with the main beam and formed of rectangular metal tubing. Contained within each strut is a second rectangular metal tube in a slidingly adjustable relation, making each leg independently adjustable.

The members that are mounted in sliding relationship are adjustable and locked in place by through going apertures and pins. The hinged wing members are locked in place by brackets of conventional design and normally used for that purpose.

In an alternative embodiment, the wing extensions are removed from the tube and secured to the wing in a vertical transverse relation where they would conveniently support long cylindrically shaped members such as pipe or circular metal tubing.

In another embodiment, an expandable workhorse has a main beam structure, rectangular in cross section, defining a main beam cavity. The main beam cavity has length, width and height dimensions, and a first and second end. The extendable beam means is positioned in said main beam cavity. A plurality of said extendable beam means are positioned in the main beam cavity of the main beam. One extendable beam of said extendable main beam means is removeably positioned in the first end of the main beam cavity and a second extendable main beam of said extendable main beam means is removeably positioned in the second end of the main beam cavity. Said one extendable main beam and said second extendable main beam each include extendable wing beams mounted thereon and in movable relation thereto. Each said secondary extendable beam may be removably positioned in said secondary beam cavity of each said secondary beam.

There is a plurality of secondary beams mounted on the main beam and movable in relation to said main beam. Each of said secondary beams has length, width and height dimensions that define a secondary beam cavity. A secondary extendable beam is positioned in said secondary beam cavity of each said secondary beam. There are leg means connected to the main beam for supporting the main beam.

It is therefore an object of the invention to provide a new and improved expandable workhorse.

It is another object of the invention to provide a new and improved expandable workhorse that is adjustable.

It is a further object of the invention to provide a new and improved expandable workhorse that is versatile in its adjustability.

It is still another object of the invention to provide a new and improved expandable workhorse that takes less space then conventional similar known devices.

It is still a further object of the invention to provide a new and improved expandable workhorse which is of a durable and reliable construction.

It is another object of the invention to provide a new and improved expandable workhorse which may be easily and efficiently manufactured and marketed.

These and other advantages, features and objects of the invention will become more apparent from the following description taken in connection with the illustrative embodiment in the accompanying drawings.

DESCRIPTION OF THE PREFERRED EMBODIMENT

Figure 1:
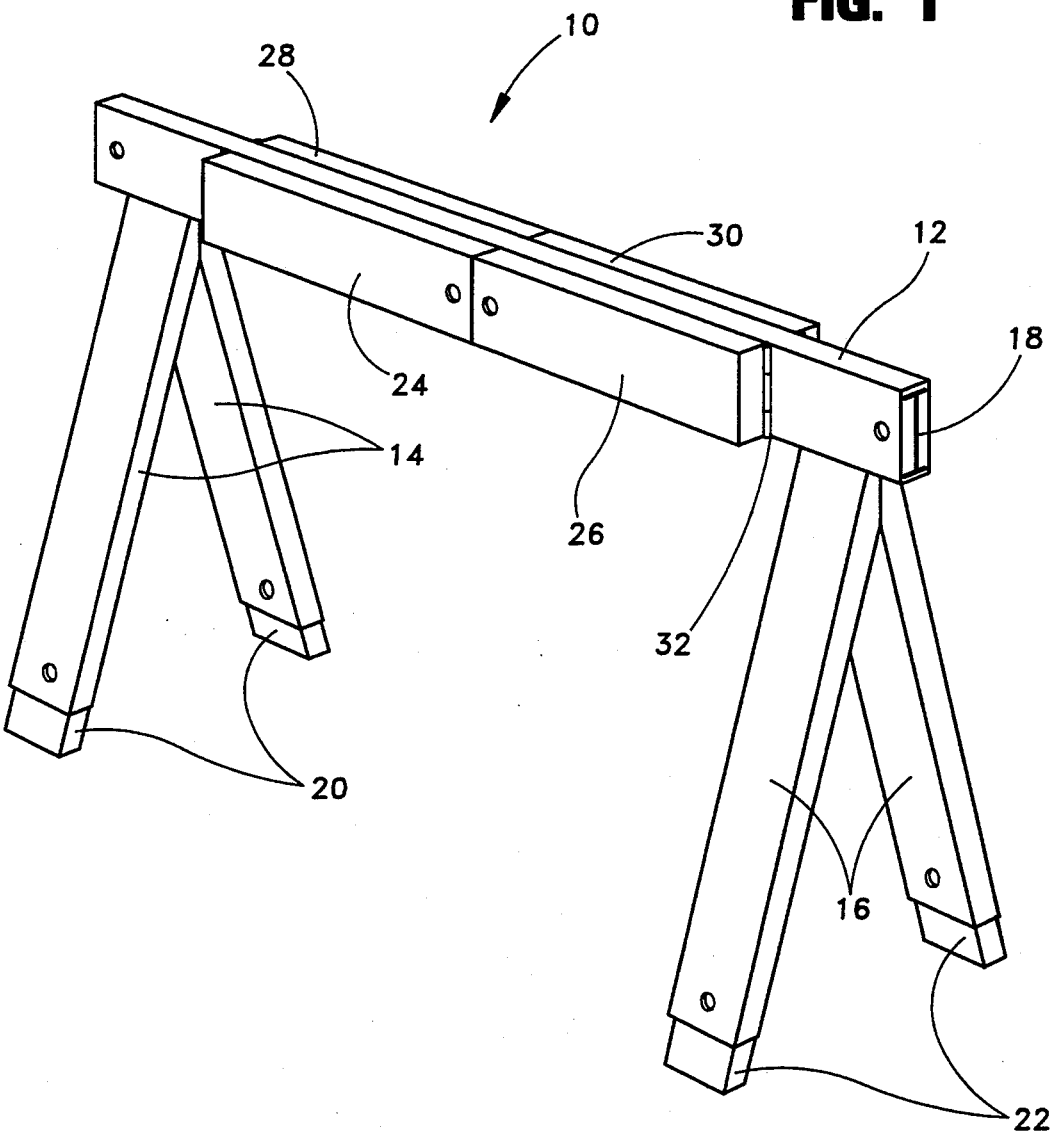
FIG. 1 is a perspective view of the invention.

Referring now to FIG. 1, the invention is shown generally at 10. Main beam 12 is supported by leg pairs 14 and 16. "I" beam 18 or extendable beam means is shown contained within the main beam cavity. Adjustable leg members for leg pairs 14 and 16 are shown at 20 and 22 respectively. Wing members or secondary beams 24,26,28 and 30 are shown in the closed condition against the main beam. The wings are hinged to the main beam as by hinge 32 engaged between the main beam and wing 26. The numerous unnumbered apertures are used when the work horse is in the expanded condition and will be detailed hereafter. The invention may be formed of steel, aluminum or a combination of known metals suitable for the purpose.

Figure 2:
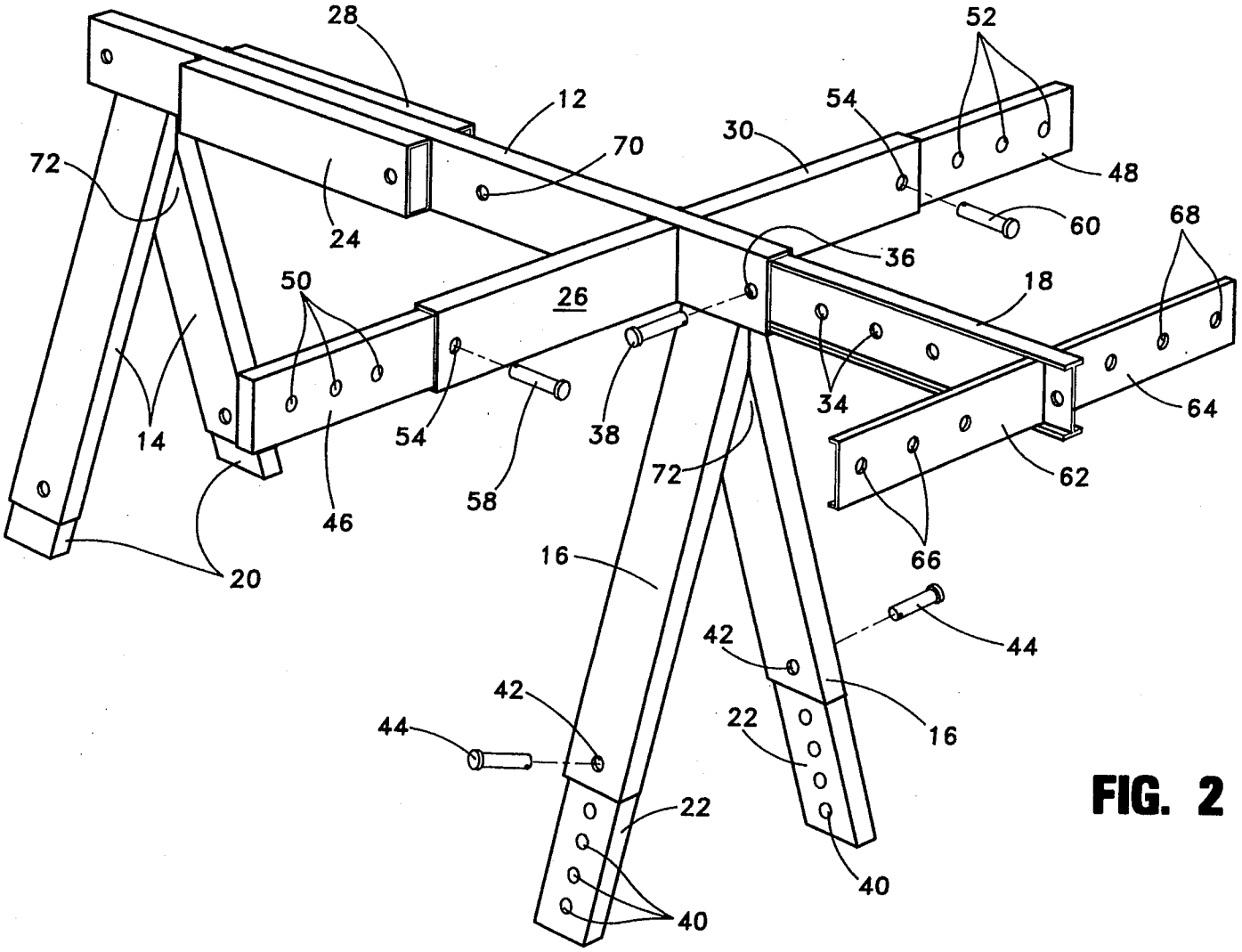
FIG. 2 is a perspective view of the invention partly expanded.

FIG. 2 illustrates the invention with the first end expanded. The workhorse is capable of functioning in multiple modes; classically, without expansion, with one end expanded, with both ends expanded, with middle only expanded and with middle and one end or middle and both ends expanded.

The main beam 12 contains expander "I" beam 18 which contains adjustment holes 34 that align with main beam through going aperture 36 which in turn accepts securing pin 38 and locks the beam 18 in the selected adjusted position. This system of adjustment is utilized throughout the invention. For example leg adjustment is accomplished with apertures 40 in the adjustable leg members 22 and through going apertures 42 in leg members 16 which receive securing pin 44 and lock the leg at the desired height. Similarly, the wing beams (26 and 30) contain rectangular adjustable expander tubes 46 or secondary extendable beams, 48 having holes 50,52 which align with through going apertures 54,56 and receive securing pins 58 and 60. The unexpanded portion of the invention is the mirror image of the expanded portion.

Expansion beam 18 has nestled within its channels wings or extendable wing beams 62 and 64, formed of channel shaped metal members. The channel may face toward or away from the beam 18 either functioning as well as the other. The extendable wing beams are hinged to the beam 18 and held in the extended position by brackets of a conventional design. The apertures 66 and 68 in the wings are coordinated with the holes 34 in beam 18 and hole 36 in the main beam whereby regardless of the placement of any of the adjustable members the securing pins will always have a clear path to engage and secure the selected members. Similarly through going aperture 70 in main beam 12 will accept a pin of the appropriate length passing through apertures 50,52 54 and 56 thereby securing the hinged wings in the closed condition.

Leg pairs 14 and 16 are affixed to the main beam 12 and may hinged in a conventional manner at their apex 72 whereby the legs will be capable of coming together and being secured by a pin 44 of appropriate length passing through holes 42.

Figure 3:
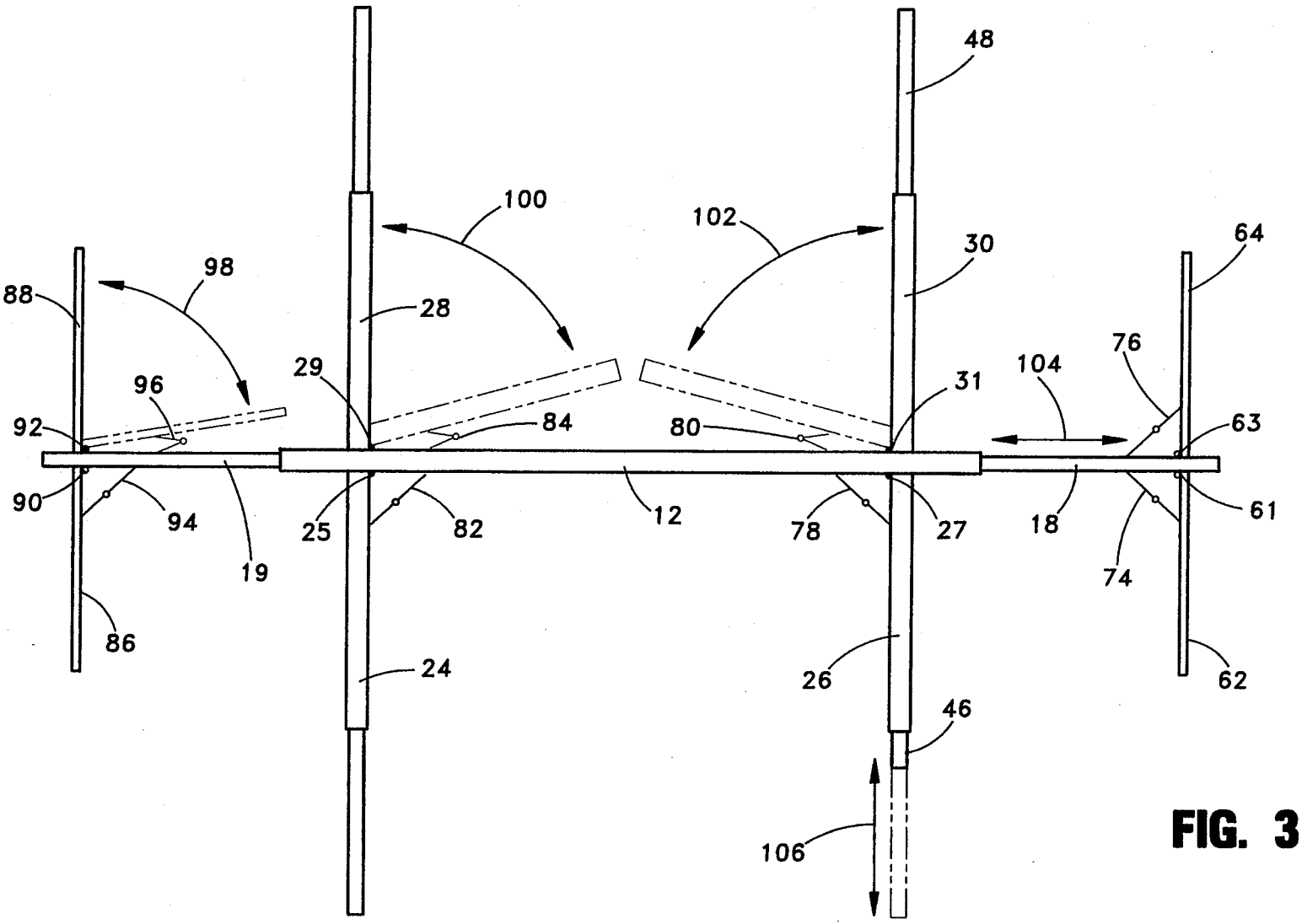
FIG. 3 is a plan view of the invention showing the wings expanded.
Figure 4:
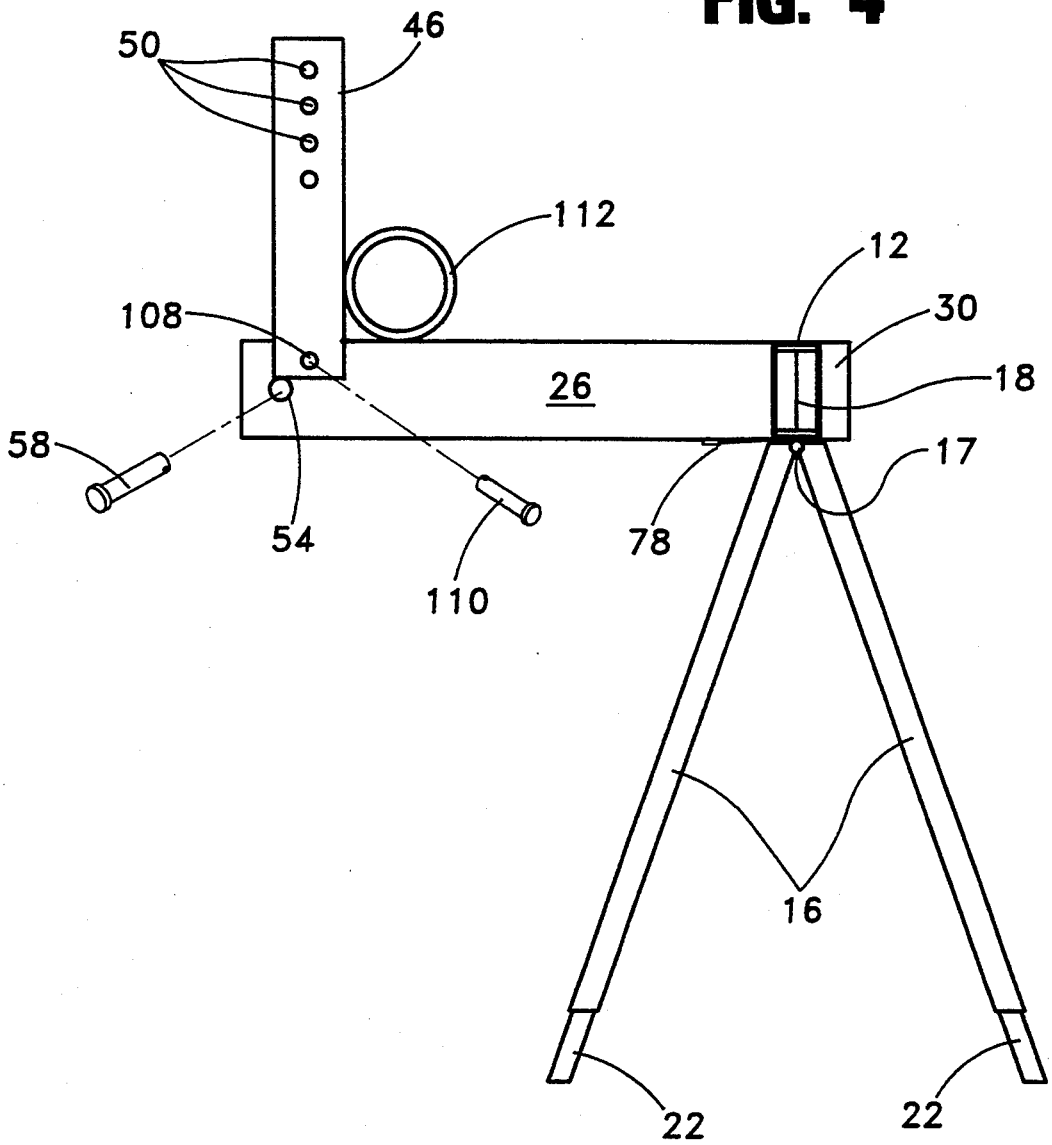
FIG. 4 is a perspective view of an alternative embodiment utilizing the wings and wing extenders.

In FIG. 3 there is shown a plan view of the invention in full expanded form. Main beam 12, with expander "I" beams 18 and 19, and channel expander wings 62 and 64 attached to beam 18 by hinges 61 and 63 and held in position by a web mounted brackets 74,76. Similarly wings 26 and 30 are fixed to the main beam by hinges 27 and 31 and held in position by brackets 78,80 mounted on the bottom surface of the beam and wing. Wings or secondary beams 24 and 28 are similar to wings 26 and 30 and are affixed by hinges 25 and 29 and held in position by collapsible bottom mounted brackets 82 and 84. The "I" beam or second extendable 19 is shown extended with channel wings 86 and 88 hinged at 90,92 and secured in position by mid-web mounted brackets 94,96. The members are movable in the directions shown by the arrows combined with their phantom representations 98,100,102,104 and 106.

In an alternative embodiment, main beam 12 is shown supported by a pair of legs 16, hinged at 17 and fixed to the underside of the beam. Beam 18 is shown within the main beam and wing 30 is folded in the unexpanded position for clarity. Wing 26 is in the expanded position and held by bracket 78. Expander tube 46 is now mounted in juxtaposition with wing 25 being secured by a pin 58 of appropriate length engaging hole 54 in wing 26. An additional hole 108 is provided and passes through members 26 and 46 and is adapted to receive securing pin 110. When in place, the invention is particularly adaptable to receiving materials such as pipe 112 or electrical conduit.

It should be understood, of course, that the foregoing disclosure relates to only a preferred embodiment of the invention and that numerous modification or alterations may be made therein without departing from the spirit and scope of the invention as set forth in the appended claims.

What is claimed is:

1. An expandable workhorse comprising in combination:

a main beam structure, rectangular in cross section, defining a main beam cavity having length, width and height dimensions, and a first and second end;

extendable beam means positioned in said main beam cavity;

a plurality of said extendable beam means positioned in the main beam cavity of the main beam;

one extendible beam of said extendable main beam means is removeably positioned in the first end of the main beam cavity and a second extendable main beam of said extendable main beam means is removeably positioned in the second end of the main beam cavity;

said one extendable main beam and said second extendable main beam each include extendable wing beams mounted thereon and in movable relation thereto;

a plurality of secondary beams mounted on the main beam and movable in relation to said beam, each of said secondary beams having length, width and height dimensions that define a secondary beam cavity;

a secondary extendable beam positioned in said secondary beam cavity of each said secondary beam; and leg means connected to the main beam for supporting the main beam.

2. An expandable workhorse according to claim 1, wherein each said secondary extendable beam further includes being removably positioned in said secondary beam cavity of each said secondary beam.

3. An expandable workhorse according to claim 2 wherein: the first and second extendable main beams are adjustable along the longitudinal axis of the main beam.

4. An expandable workhorse according to claim 3 wherein: the secondary beam extendable means are adjustable along an axis transverse to the longitudinal axis of the main beam.

5. An expandable workhorse according to claim 4 wherein: the leg means are each adjust for length.

6. An expandable workhorse according to claim 5 wherein: there are four secondary beams mounted on the main beam.

7. An expandable workhorse according to claim 6 wherein: said four secondary beams are each affixed by hinge means to the main beam.

8. An expandable workhorse according to claim 7 wherein: the secondary beams are held in the extended position by a bracket.

9. An expandable workhorse according to claim 8 wherein: the extendable beams are adjustably secured by means of a pin receiving hole.

10. An expandable workhorse according to claim 9 wherein: the workhorse is formed of metal.

11. An expandable workhorse according to claim 10 wherein: the workhorse is formed of steel.

12. An expandable workhorse according to claim 10 wherein: the workhorse is formed of aluminum.

13. An expandable workhorse according to claim 10 wherein: the workhorse is formed of a combination of metals.

* * * * *